US011814219B2

(12) United States Patent
Schmidt et al.

(10) Patent No.: US 11,814,219 B2
(45) Date of Patent: Nov. 14, 2023

(54) CLOSURE

(71) Applicant: OBRIST CLOSURES SWITZERLAND GMBH, Reinach (CH)

(72) Inventors: Patrick Schmidt, Zell-Kaimt (DE); Rainer Schawo, Zell (DE)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

(21) Appl. No.: 17/613,572

(22) PCT Filed: May 25, 2020

(86) PCT No.: PCT/EP2020/064457
§ 371 (c)(1),
(2) Date: Nov. 23, 2021

(87) PCT Pub. No.: WO2020/239703
PCT Pub. Date: Dec. 3, 2020

(65) Prior Publication Data

US 2022/0242625 A1 Aug. 4, 2022

(30) Foreign Application Priority Data

May 26, 2019 (GB) ..... 1907444

(51) Int. Cl.
*B65D 47/20* (2006.01)

(52) U.S. Cl.
CPC ..... *B65D 47/2006* (2013.01); *B65D 2215/04* (2013.01); *B65D 2401/00* (2020.05)

(58) Field of Classification Search
CPC .... B65D 47/2006; B65D 47/08; B65D 55/02; B65D 2215/04; B65D 2401/00; B65D 2401/15
USPC ..... 222/153.4, 533, 534, 556
See application file for complete search history.

(56) References Cited

U.S. PATENT DOCUMENTS 5,058,775 A * 10/1991 Gross ..... B65D 47/2006 222/153.07
5,205,424 A * 4/1993 Gaspar ..... B65D 83/0481 222/533
5,284,264 A * 2/1994 Gross ..... B65D 47/2006 215/206
5,709,318 A * 1/1998 Oder ..... B65D 47/2006 222/536
6,029,866 A 2/2000 Wood et al.
(Continued)

FOREIGN PATENT DOCUMENTS

WO 2017046186 3/2017

OTHER PUBLICATIONS

International Search Report and Written Opinion for PCT/EP2020/064457 dated Aug. 11, 2020.

*Primary Examiner* — Charles P. Cheyney
(74) *Attorney, Agent, or Firm* — Barnes & Thornburg LLP

(57) ABSTRACT

A dispensing closure (10) comprising an actuator disc (20) and a base (15) is provided. The disc is pivotally mounted on the base and is pivotable between a closed position which prevents fluid product dispensing and an open position which allows product fluid dispensing. The closure comprises a transport lock (24) for preventing the disc moving from the closed to the open position.

18 Claims, 9 Drawing Sheets

(56) References Cited

U.S. PATENT DOCUMENTS

| | | | | |
|---|---|---|---|---|
| 6,186,365 | B1 * | 2/2001 | DeJonge | B05B 11/3059 222/321.9 |
| 6,343,725 | B1 * | 2/2002 | Lohrman | B65D 47/2006 222/536 |
| 6,832,700 | B2 * | 12/2004 | Roberts | B65D 47/2006 222/546 |
| 9,914,567 | B2 * | 3/2018 | Brem | B65D 47/065 |
| 10,266,313 | B2 * | 4/2019 | Jelich | B65D 50/06 |
| 11,383,897 | B2 * | 7/2022 | Lalier | B65D 55/02 |
| 2012/0305519 | A1 | 12/2012 | Lee et al. | |

* cited by examiner

CLOSURE

CROSS REFERENCE TO RELATED APPLICATIONS

This application is a U.S. national stage application under 35 U.S.C. § 371(b) of International Application No. PCT/EP2020/064457, filed May 25, 2020, which claims priority to the United Kingdom Patent Application No. 1907444.2, filed on May 26, 2019, the disclosures of both of which are hereby expressly incorporated by reference in their entirety.

This invention relates generally to a dispensing closure for a container and particularly, although not exclusively, to a disc top dispensing closure.

In known closures of this type, which are typically formed from injection moulded plastics, a spout is formed as part of a disc-like lid which is pivotably connected to a closure cap or base for rocking or tilting movement between open and closed positions. Such container and closure combinations may contain and dispense products in the form of, for example, particulates, pastes, creams, liquids, granules, or aerosols.

The present invention seeks to provide improvements in or relating to disc top type closures.

An aspect of the present invention provides a dispensing closure comprising an actuator disc and a base, the disc is pivotally mounted on the base and is pivotable between a closed position which prevents fluid product dispensing and an open position which allows product fluid dispensing, the closure comprises a transport lock for preventing the disc moving from the closed to the open position.

The transport lock may comprise a lock member provided on or by the disc that is movable between a locked position and an unlocked position.

A further aspect of the present invention provides a dispensing closure actuator disc which is pivotally mountable on a base that is itself attachable to a container, the disc being pivotable between a closed position which prevents fluid product dispensing and an open position which allows product fluid dispensing, the disc comprises a transport lock for preventing the disc moving from the closed to the open position.

The transport lock may comprise a lock member that is movable between a locked position and an unlocked position.

The transport lock may comprise a lock member that is movable from a locked position to an unlocked position.

In some aspects and embodiments the idea is to have a tamper-evident band/tab/clip below the disc in order to avoid opening of the closure. Once the TE band is pressed into the side skirt opening is facilitated.

Opening during transport can be avoided. In addition, loose parts can be avoided.

In some embodiments the pressing of the TE element is irreversible.

The TE element may be located at a "rear" end of a disc top, for example generally opposite a dispensing opening formed in the lid.

Some aspects and embodiments may relate to a transport safety feature for a disc top closure. The feature may hold the disc in the closed position and must be activated to allow the disc to be moved to the open/dispensing position.

The lock member may comprise a press(able) member.

The lock member may comprise a strip, band, strap or the like.

The lock member may comprise one or more bend/hinge/fold lines. This may be included to facilitate or allow movement from the lock to the unlocked position. For example the lock member may include two bend lines.

The disc may be generally circular.

In some embodiments the lock member moves radially inwards.

The disc may include a frontal dispensing outlet.

The lock member may be provided at a rear of the disc.

The lock member may be formed as part of the disc. For example the lock member may be formed as an integral part by moulding.

The lock member may remain attached to the disc, both in the locked and unlocked positions i.e. it does not detach in order to disengage.

The lock member may be biased towards the locked position and movable to the unlocked position.

The lock member may be initially in the locked position and movable to a stable unlocked position.

In some embodiments the lock member is initially in the locked position and is irreversibly movable to the unlocked position.

The base and the disc may be formed from different materials.

The base may be non-removably attachable to a container. For example a snap bead or the like may be provided.

The base may, for example, be generally cylindrical or generally oval.

The disc may comprise a top plate and a depending sidewall.

In some embodiments the sidewall includes a gap/notch/recess into which the transport lock can be pressed to move it to its unlocked position.

The disc may comprise a recess for assisting movement to the open position.

The base may comprise a sidewall notch. This can be used, for example, to facilitate pressing down of the lid.

The closure may comprise tamper-evident means for indicating if the disc has moved from an initially closed position to the open position. In some embodiments the transport lock also functions as tamper-evident means e.g. if it moves to and remains in the unlocked position. In other embodiments additional tamper-evident feature/s may be provided.

The base may comprise tamper-evident means for indicating if the base has been removed from a container, for example a drop band.

A further aspect provides a disc top closure comprising a body, a spout is formed as part of a disc-like lid which is pivotably connected to a closure cap or base for rocking or tilting movement between open and closed positions, the closure comprises a transport safety feature.

According to further aspect of the present invention there is provided a dispensing closure comprising a base attachable to a container and an actuator disc pivotally mounted on the base, the disc being pivotable between a closed position which prevents fluid product dispensing and an open position which allows product fluid dispensing, In some aspects and embodiments the base and the disc are formed from different materials.

Forming the components from different materials allows, for example, different properties to be provided such as colour, transparency, strength and friction.

The base and disc materials may both be thermoplastic polymers.

In some embodiments the materials may be the same type of material, for example the base and disc may both be formed from a polypropylene-based material. Other materials, such as polyethylene may be used. In some embodiments different polymers classes may be used.

In some embodiments one of the base and disc may be formed from a copolymer polypropylene and the other may be formed from a homopolymer polypropylene. In one embodiment, for example, the base is formed from a homopolymer polypropylene and the disc is formed from a copolymer polypropylene.

In some embodiments the resin selected is a homopolymer for the body and a copolymer for the disc.

The base and/or the disc may additionally include an interference member. The member may be provided to prevent tilting of the actuator disc until a sufficient predetermined opening force is applied. This can be useful, for example, to prevent accidental opening of the closure.

For example the disc may include an interference member for engaging the base when disc is moved to the open position.

In some embodiments the interference member is a friction rib.

The closure may comprise a tamper-evident member for indicating if the disc has moved from an initially closed position to the open position.

In some embodiments the tamper-evident member must be activated to allow the disc to move to the open position in addition to disengagement of a transport lock. For example the member may prevent movement of the disc from the initially closed to the open position, and therefore must first be deactivated (e.g. by moving or removing it).

In other embodiments the tamper-evident member may be activated by movement of the disc to the open position. In other words the act of moving the disc from the initially closed to the open position automatically activates the tamper evidence.

In some embodiments the tamper-evident member is at least partly removed in use. For example the member may be completely removed in use.

The member may include a pull tab to assist with partial/complete removal.

At least part of the tamper-evident member may remain on the closure after first opening. For example part of the member may remain on the lid and/or base.

The tamper-evident member may be a strip or band.

The tamper-evident member may be frangibly connected to the disc in the initially closed position, for example by one or more frangible bridges. Alternatively or additionally the tamper-evident member may be frangibly connected to the base in the initially closed position, for example by one or more frangible bridges.

The base may be non-removably attachable to a container. In other embodiments the base is removably attached, for example by screw thread engagement.

The base may comprise tamper-indicating means for indicating if it has been removed from a container.

The tamper-evident member may be formed integrally with the disc and/or the base, for example by injection moulding of a plastics material.

The tamper-evident member may be at least partly removable and the member may include a pull tab or the like to facilitate removal by a user.

The base may be generally cylindrical, for example with a generally circular, oval, ellipsoidal or polygonal section.

The disc may comprise a recess for assisting movement to the open position.

The base may comprise a recess for assisting movement to the open position.

The present invention also provides a closure as described herein in combination with a container.

The present invention also provides an actuator disc suitable for use as part of a closure as described herein.

The present invention also provides a dispensing closure actuator disc which is pivotally mountable on a base that is itself attachable to a container, the disc being pivotable between a closed position which prevents fluid product dispensing and an open position which allows product fluid dispensing, the disc comprises a transport lock for preventing the it from moving from the closed to the open position when mounted on a base.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

Examples of aspects and embodiments of the present invention are shown in the accompanying drawings.

In the following description, all orientational terms, such as upper, lower, front, rear, radially and axially, are used in relation to the drawings and should not be interpreted as limiting on the invention or its connection to a closure.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

BRIEF DESCRIPTIONS OF THE DRAWINGS

DETAILED DESCRIPTION

Figure 1:
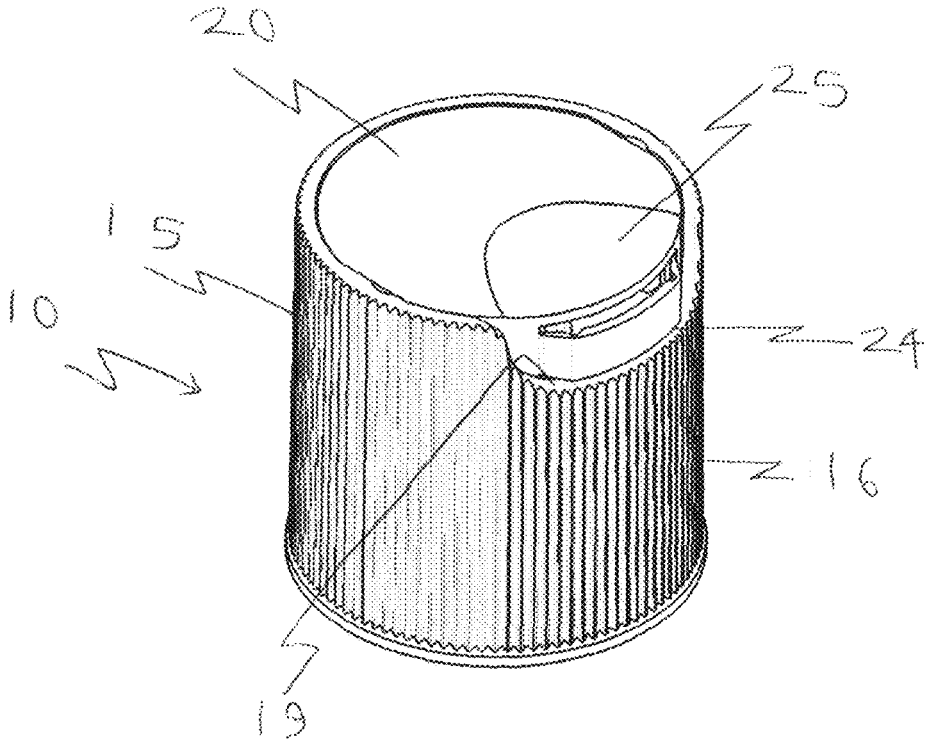
FIG. 1 is a perspective view of a dispensing closure.
Figure 2:
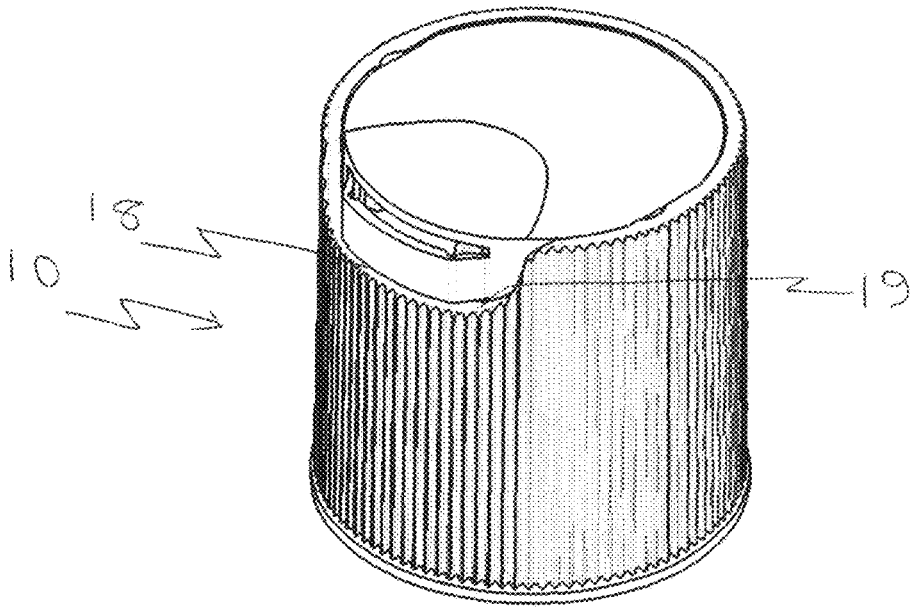
FIG. 2 is another perspective view of the dispensing closure.
Figure 3:
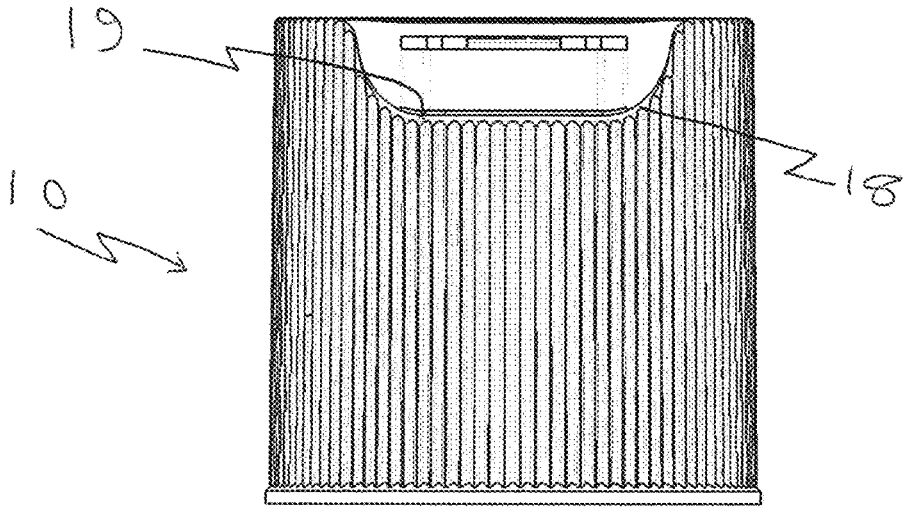
FIG. 3 is a side elevation view of the dispensing closure.
Figure 4:
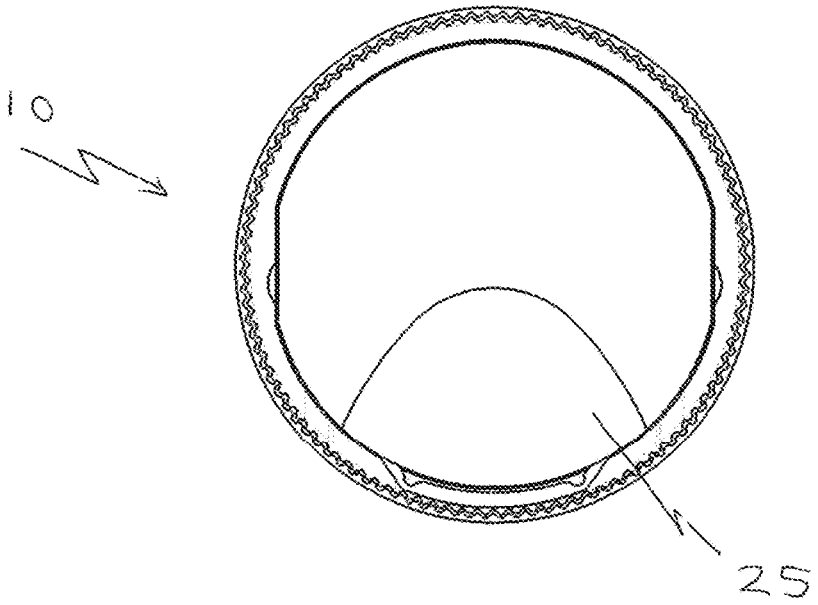
FIG. 4 is a top view of the dispensing closure.
Figure 5:
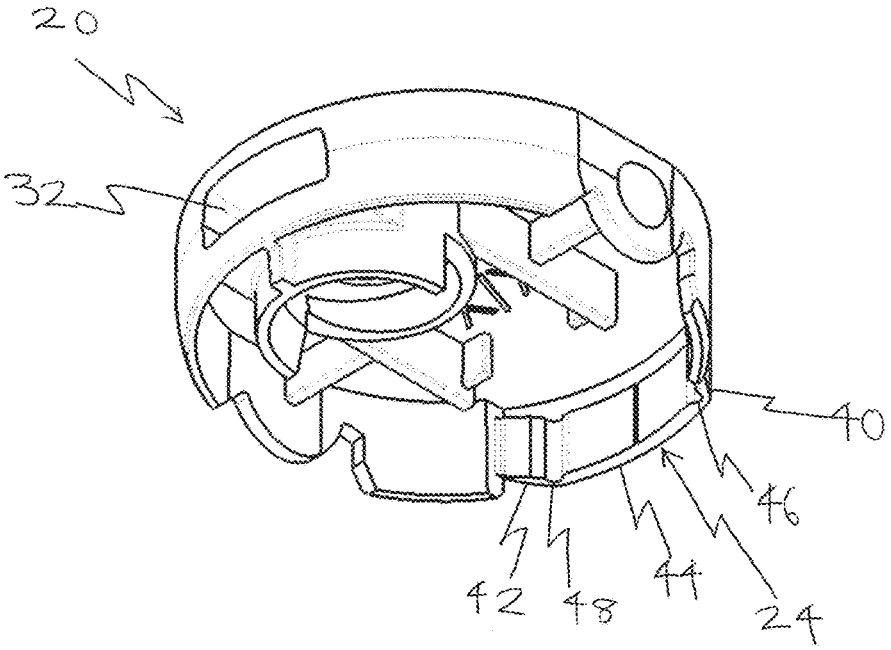
FIG. 5 is a perspective view of a lid included in the dispensing closure of FIGS. 1-4.
Figure 6:
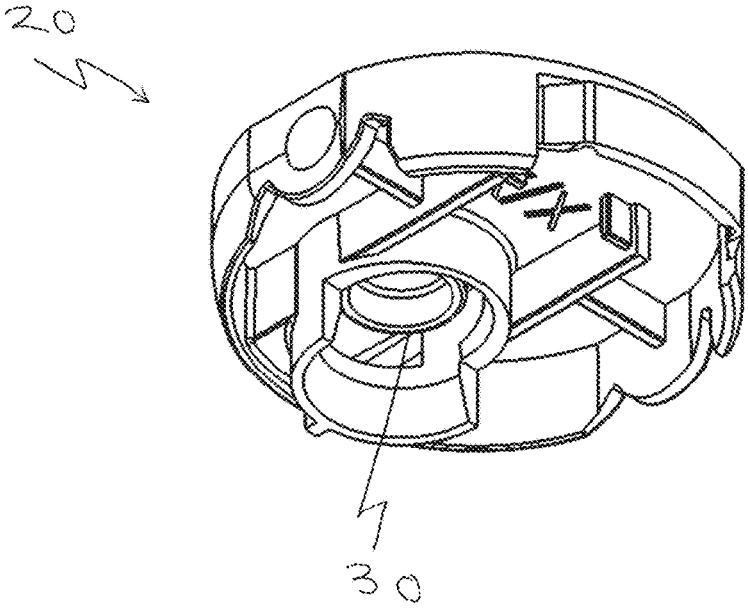
FIG. 6 is another perspective view of the lid included in the dispensing closure of FIGS. 1-4.
Figure 7:
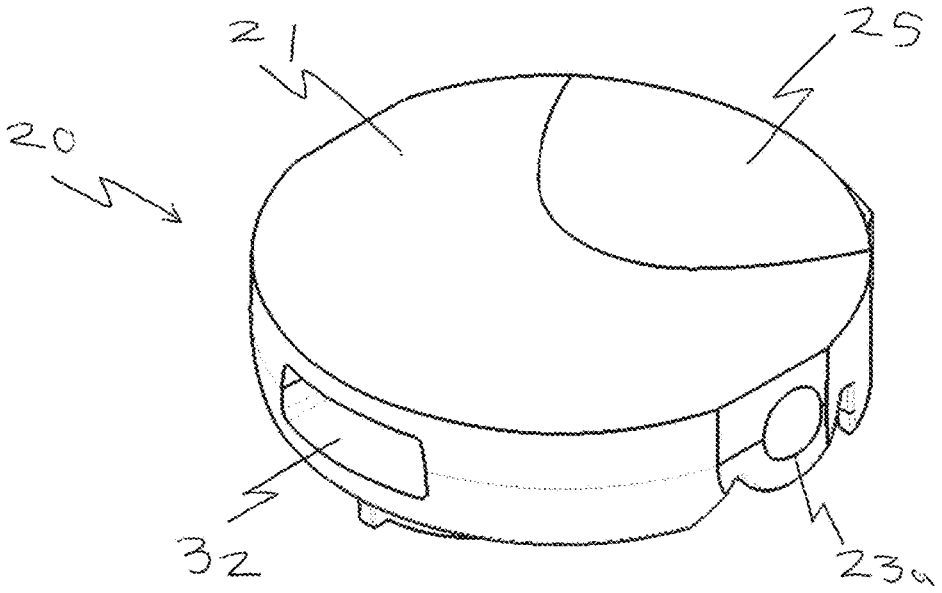
FIG. 7 is another perspective view of the lid included in the dispensing closure of FIGS. 1-4.
Figure 8:
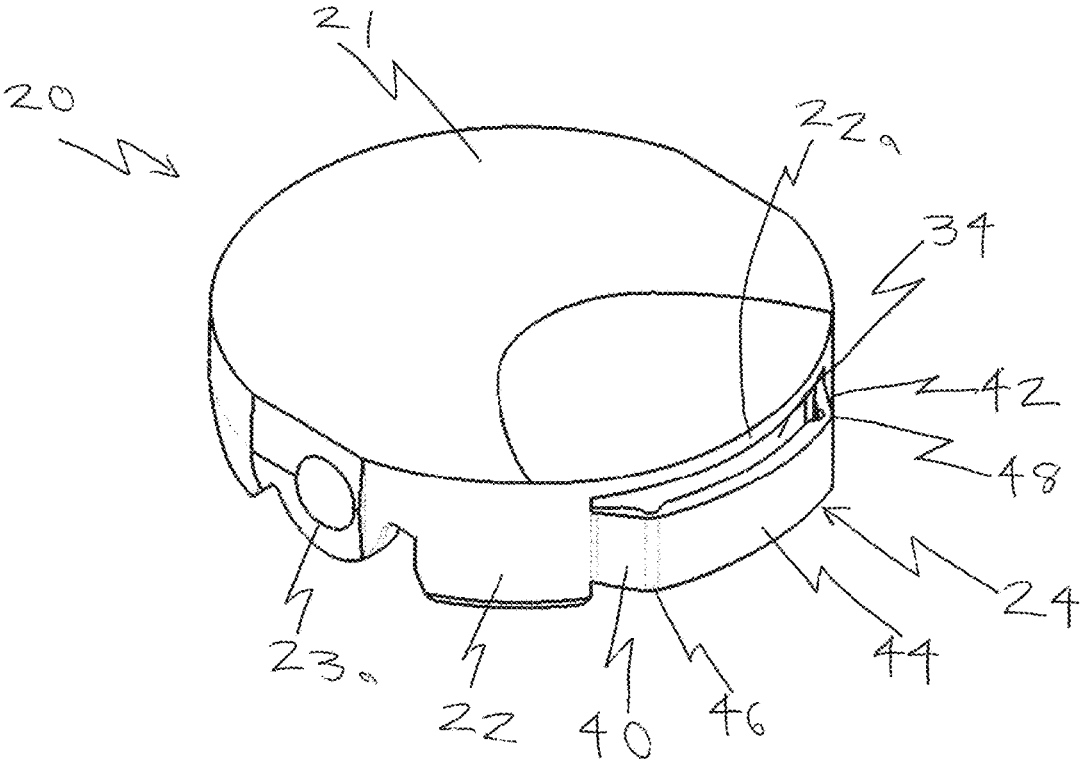
FIG. 8 is another perspective view of the lid included in the dispensing closure of FIGS. 1-4.
Figure 9:
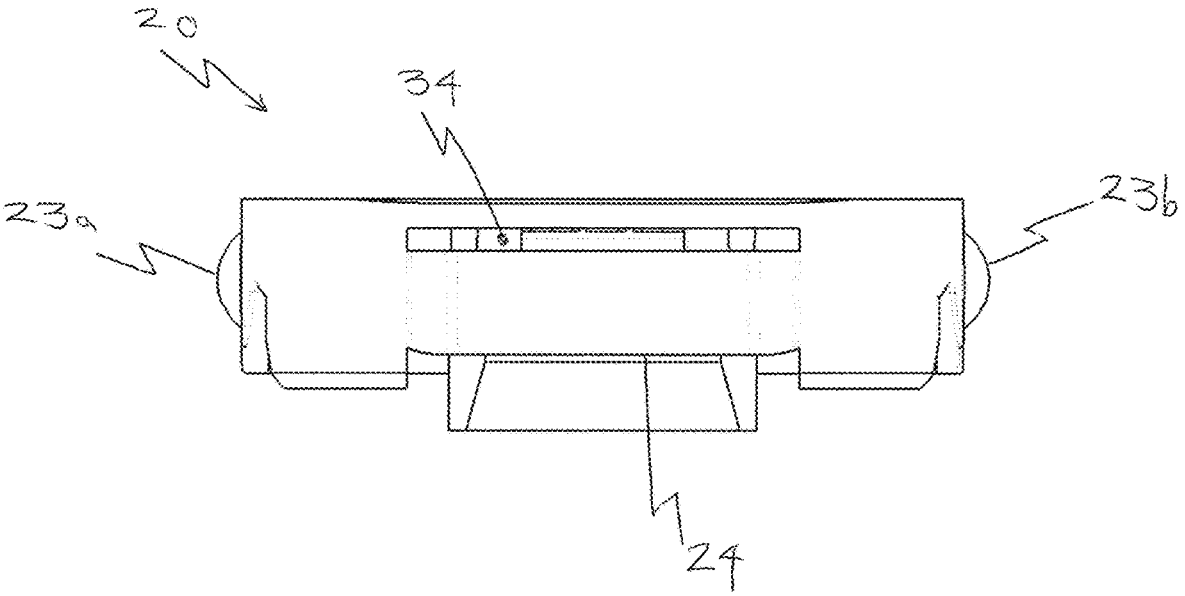
FIG. 9 is a front elevation view of the lid included in the dispensing closure of FIGS. 1-4.
Figure 10:
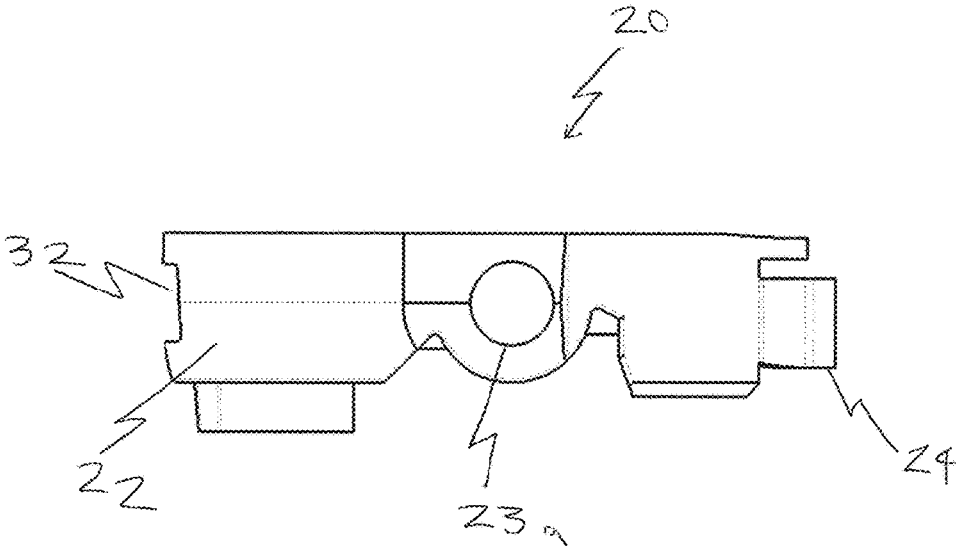
FIG. 10 is a side elevation view of the lid included in the dispensing closure of FIGS. 1-4.
Figure 11:
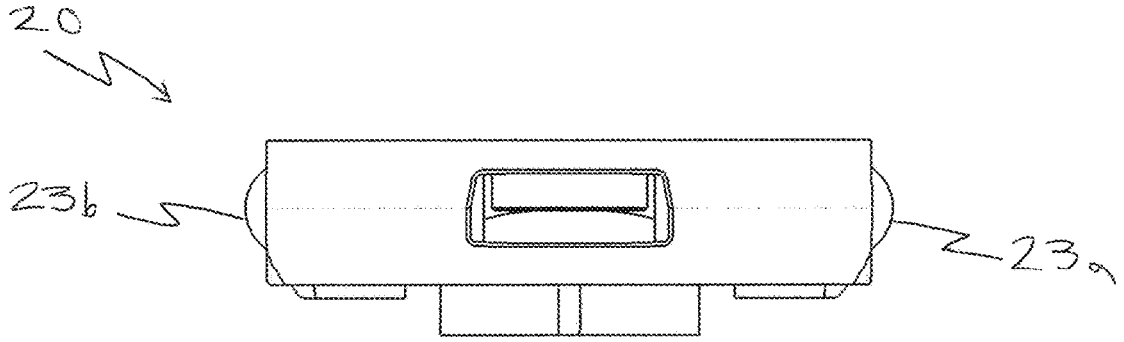
FIG. 11 is a rear elevation view of the lid included in the dispensing closure of FIGS. 1-4.
Figure 12:
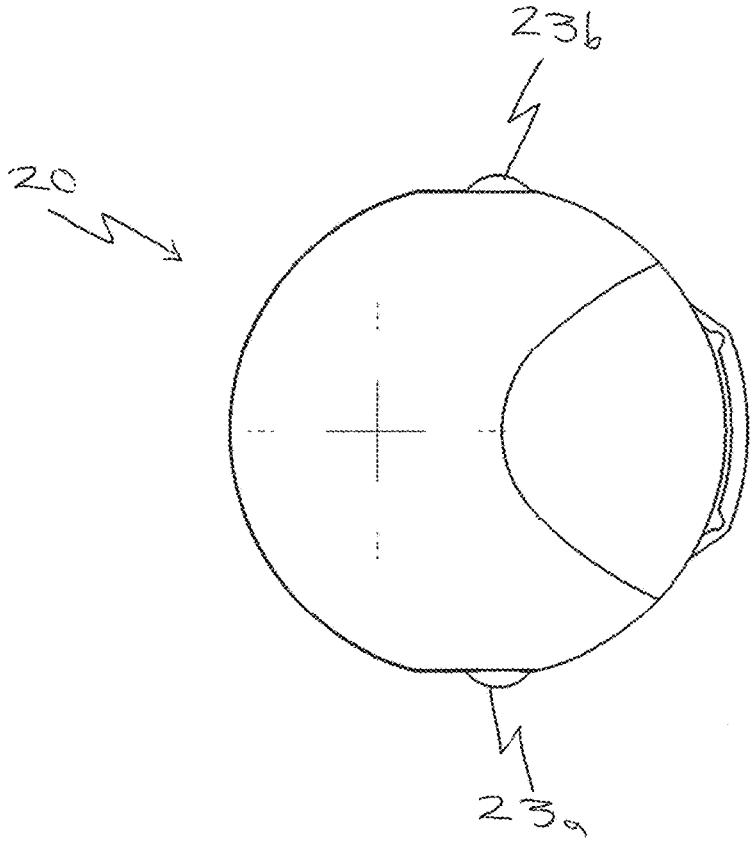
FIG. 12 is a top view of the lid included in the dispensing closure of FIGS. 1-4.

Referring first to FIGS. 1 and 4 there is shown a disc-top or toggle-action style dispensing closure generally indicated 10. The closure comprises a generally cylindrical base 15 and a lid 20 (or actuator disc) pivotally mounted to the base 15. In this embodiment the material from which the base and lid is made is generally the same (although the colour may be different). In other embodiments the material from which the base and lid are formed may be different e.g. different types of a polymeric material such as polypropylene.

The base is mountable on a container neck (not shown) for example by screw thread, ratchet, lugs, bayonet or snap bead engagement.

The base 15 comprises a generally cylindrical sidewall 16. One end of the sidewall has a notch or cut-out portion 18.

Referring now also to FIGS. 5 to 12 the lid 20 is generally disc-like, with a circular top plate 21 and a sidewall 22 depending from the periphery thereof. Two diametrically opposed pivot projections or trunnions 23*a*, 23*b* are provided and engage in corresponding sockets/recesses in the interior of the base sidewall. This allows the lid to pivot with respect to the base.

At the rear of the lid, a notch/gap 34 is formed in the sidewall 22. Across the gap a transport lock strip 24 is provided. The strip 24 is non-frangibly attached at either side to the sidewall by an inclined portion 40, 42. A central portion 44 extends between the portions 40, 42 and is joined thereto by thinned bend lines 46, 48.

The inclined portions 40, 42 position the central portion member 44 radially outwards of the top plate 21 and the truncated sidewall section 22*a* that defines the notch 18. This locates the locking member 24 so that it sits in the sidewall notch 18, directly above the section of sidewall 19 forming the notch.

The top plate 21 includes a pressing depression 25 at one side adjacent the member 24 for manually pivoting the lid to an open position.

The lid comprises a dispensing channel which commences with a dispensing inlet 30 on the underside of the lid and terminates with a dispensing opening 32 generally opposite the member 24. In the closed position the opening 32 is blocked and in the open position the opening 32 is unblocked and a dispensing path is established between the container and the opening, through the base and then through a channel in the lid.

In use, with the strip 24 positioned over the wall section 19 the lid cannot be pushed down (accidentally or deliberately). This could be useful for avoiding accidental opening and could be useful, for example, for preventing the lid being pushed down by a child.

Figure 13:
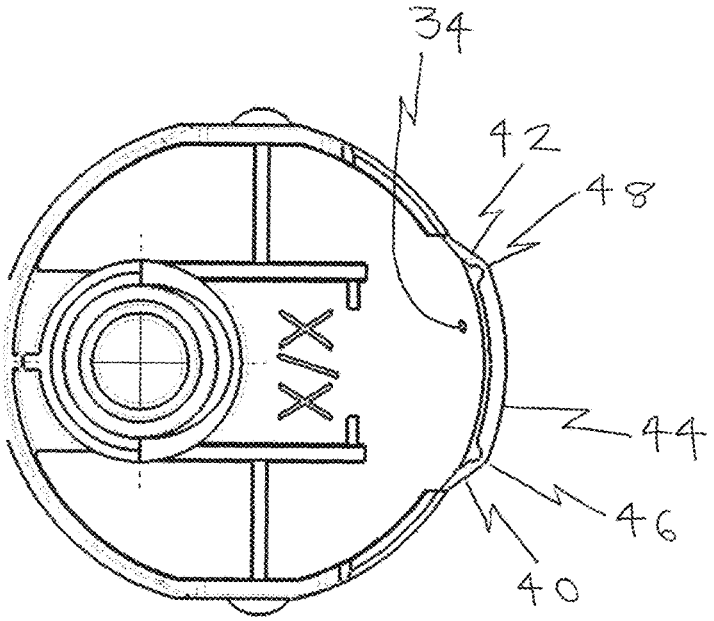
FIG. 13 is a bottom view of the lid included in the dispensing closure of FIGS. 1-4.
Figure 14:
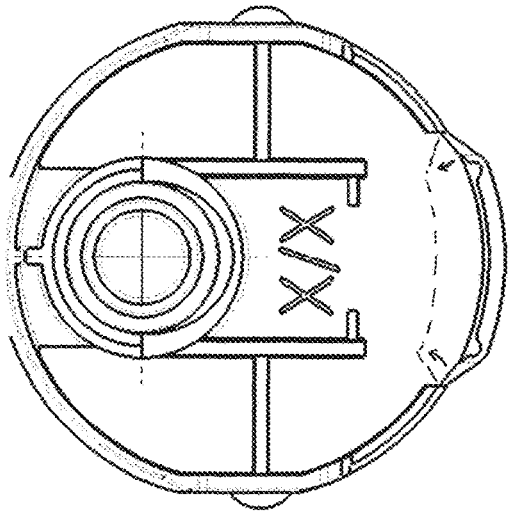
FIG. 14 is another bottom view of the lid included in the dispensing closure of FIGS. 1-4.

In order to be able to press the lid down the strip must first be pressed inwards (into the gap 34) from the position shown in FIG. 13 to the position shown in FIG. 14.

In this embodiment, when the strip is pressed it moves into the gap 34 by causing the portions 40, 42 to change their inclination and bend inwards, as represented by the dotted line in FIG. 14. In doing so the central portion 44 is displaced radially inwards.

With the strip in the inwards/unlocked position and therefore no longer above the wall section 19 the lid 20 is then movable from a closed position to an open position by pressing downward on the depression 25, thereby pivoting the lid on the base, lifting the opposite side of the lid and exposing a discharge opening 32.

In this embodiment once the strip 24 is pressed in it does not return to the locked position when the lid is placed back in the closed position. This could be useful, for example for a tamper-evident function with a tamper member that remains attached (i.e. not something like a tear-off tab). In some embodiments a member that is effectively permanently moved and/or deformed could therefore function as both a transport lock and a tamper-evident feature, for example. In other embodiments the member is purely a transport lock.

In other embodiments the strip is biased to the outward position and movable inwards; it would then return to an outwards position, for example, when the lid is reclosed.

In this embodiment the central portion 44 is not deformed as it moves inwards. In other embodiments the portion 44 is deformed.

Figure 15:
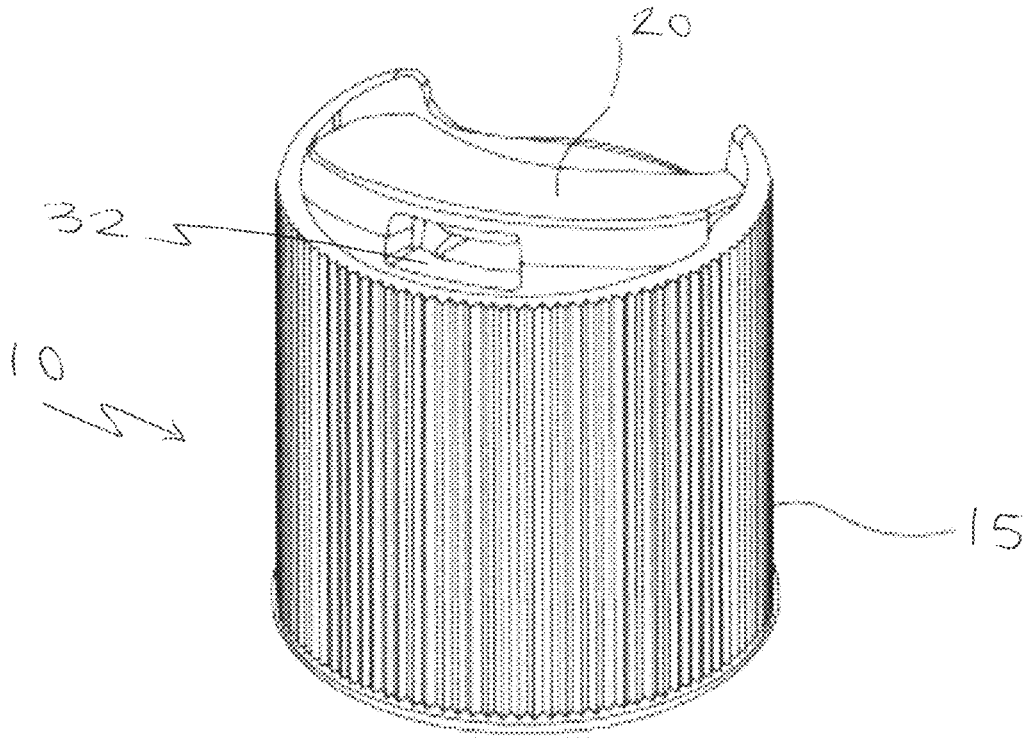
FIG. 15 is a perspective view of the closure showing the lid pivoted to an open position.

FIG. 15 shows the lid pivoted to the open position on the base.

Figure 16:
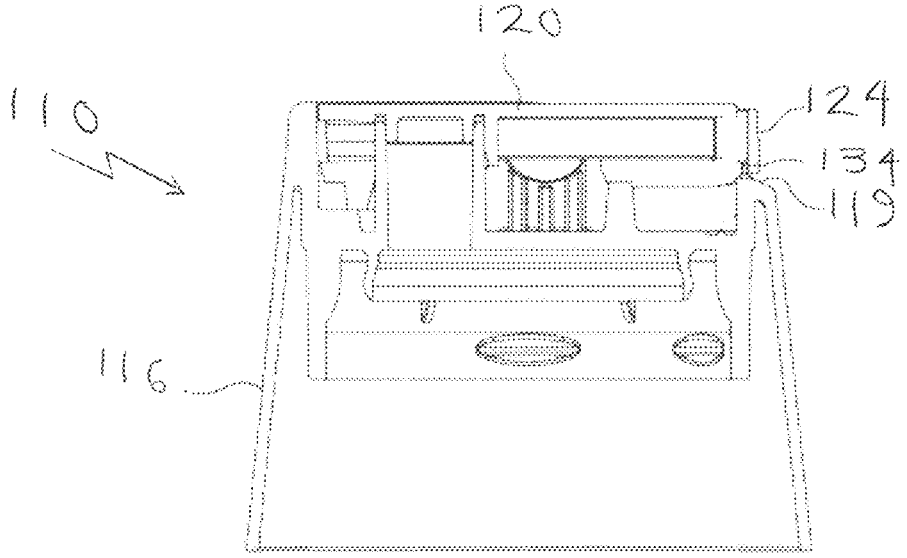
FIG. 16 is a sectional view of another embodiment of a closure including a lid and showing the lid in a closed position.
Figure 17:
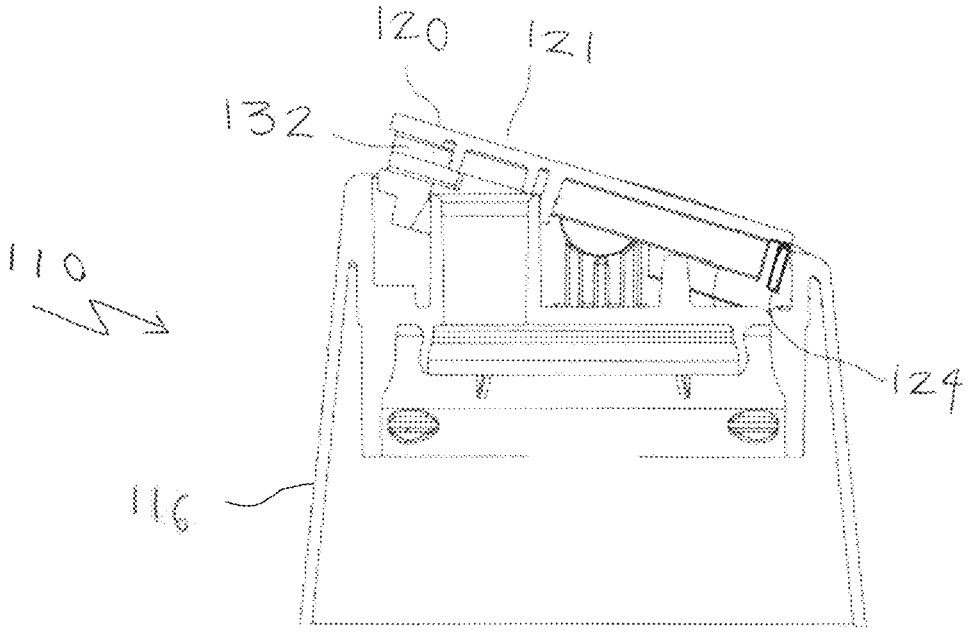
FIG. 17 is a sectional view of the closure of FIG. 16 showing the lid in the open position.

FIGS. 16 and 17 show sectional views of closed and open positions of a closure 110 formed according to a further embodiment.

Figure 18:
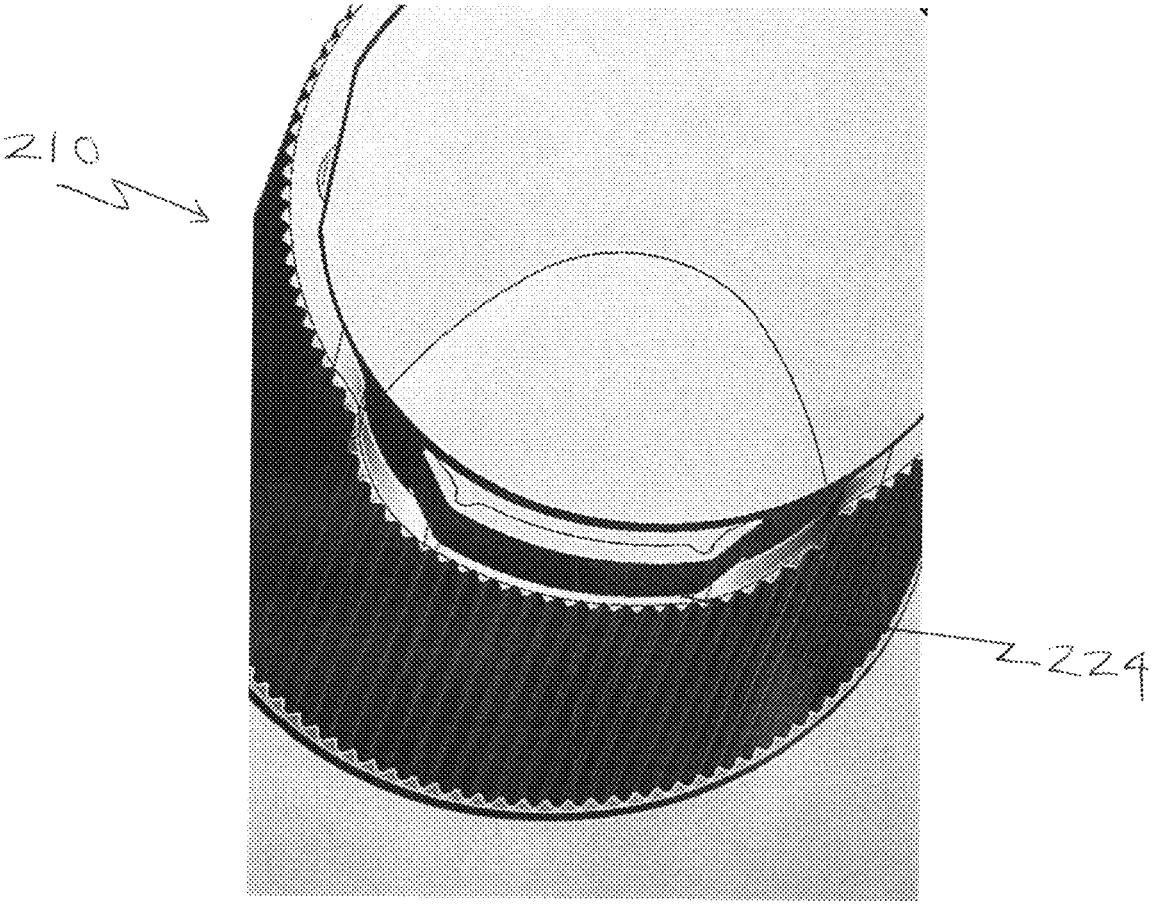
FIG. 18 is a partial perspective view of another embodiment of a closure.

FIG. 18 shows a rear perspective view of a closure 210 formed according to a further embodiment.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A dispensing closure comprising
an actuator disc and
a base,
wherein the actuator disc is pivotally mounted on the base and is pivotable between a closed position which prevents fluid product dispensing and an open position which allows product fluid dispensing,
wherein the dispensing closure further comprises a transport lock for preventing the actuator disc moving from the closed to the open position,
wherein the transport lock comprises a pressable strip formed as part of the actuator disc that is movable from a locked position to an unlocked position,
wherein the pressable strip comprises a central portion which is displaced radially inwards when pressed,
wherein the disc comprises a disc sidewall and the pressable strip is non-frangibly attached at either side to the disc sidewall by an inclined portion that is attached to the disc sidewall by a first pair of bend lines, and in which the central portion extends between the inclined portions and is joined thereto by a second pair of bend lines, and
wherein the inclined portions are configured to change inclination and extend inward when the pressable strip is pressed.

2. The dispensing closure of claim 1, wherein the base comprises a base sidewall and the base sidewall comprises a notch formed by a wall section, and in which in the locked position the pressable strip is positioned over the wall section to prevent the actuator disc moving to the open position.

3. The dispensing closure of claim 1, wherein the actuator disc comprises a top plate and a disc sidewall depending from the periphery thereof.

4. The dispensing closure of claim 3, wherein a gap is formed in the disc sidewall and the pressable strip is formed across the gap.

5. The dispensing closure of claim 1, wherein the actuator disc is generally circular.

6. The dispensing closure of claim 5, wherein the pressable strip moves radially inwards.

7. The dispensing closure of claim 1, wherein the actuator disc includes a frontal dispensing outlet.

8. The dispensing closure of claim 1, wherein the pressable strip is provided at a rear of the actuator disc.

9. The dispensing closure of claim 1, wherein the pressable strip remains attached to the actuator disc.

10. The dispensing closure of claim 1, wherein the pressable strip is biased towards the locked position and movable to the unlocked position.

11. The dispensing closure of claim 1, wherein the pressable strip is initially in the locked position and movable to a stable unlocked position.

12. The dispensing closure of claim 1, wherein the pressable strip is initially in the locked position and is irreversibly movable to the unlocked position.

13. The dispensing closure of claim 1, wherein the base and the actuator disc are formed from different materials.

14. The dispensing closure of claim 13, wherein the base is generally cylindrical.

15. The dispensing closure of claim 1, wherein the actuator disc comprises a pressing depression for assisting movement to the open position.

16. The dispensing closure of claim 1, wherein the closure comprises tamper-evident means for indicating if the actuator disc has moved from an initially closed position to the open position.

17. The dispensing closure of claim 1, wherein, in the locked position, the central portion is generally convexly curved and, in the unlocked position, the central portion is generally convexly curved.

18. The dispensing closure of claim 1 in combination with a container.

* * * * *